United States Patent [19]

Miller

[11] 4,093,410

[45] June 6, 1978

[54] DITCH PAVING TOOL

[75] Inventor: Charles P. Miller, McHenry, Ill.

[73] Assignee: Miller Formless Co., Inc., McHenry, Ill.

[21] Appl. No.: 761,272

[22] Filed: Jan. 21, 1977

[51] Int. Cl.[2] ..... 404 104; E02B 11/02

[52] U.S. Cl. ..... 425/59; 404/98; 425/63

[58] Field of Search ..... 404/105, 104, 118, 96, 404/98; 61/63; 425/59, 63–65

[56] References Cited

U.S. PATENT DOCUMENTS

| | | | |
|---|---|---|---|
| 3,109,351 | 11/1963 | Dunn | 404/104 |
| 3,606,827 | 9/1971 | Miller et al. | 404/98 |
| 3,936,211 | 2/1976 | Miller et al. | 404/96 |

FOREIGN PATENT DOCUMENTS

| | | | |
|---|---|---|---|
| 577,604 | 5/1933 | Germany | 404/118 |

*Primary Examiner*—Francis S. Husar
*Assistant Examiner*—John McQuade
*Attorney, Agent, or Firm*—Bruce K. Thomas

[57] ABSTRACT

A slip form or mule for continuously laying concrete along one or more adjacent lanes on the sloping side of a contoured drainage ditch. The slip form is affixed to or movably mounted from a construction machine that travels along the top berm of the ditch. A tool frame support slideably contains a form having an open top and bottom with longitudinally adjustable and segmented side walls and is suspended from cooperating derrick and pivotal frame supports along the side of the machine for registry with and travel spaced above the sloping side of the ditch. A flexible finishing pan follows the form means in the plane of its bottom edges and includes adjustable supports suspending or compressing the pan in relation to the concrete slab being laid. The tool frame support has a pair of rigid vertical spaced side walls with outwardly directed opposite and coplanar bottom flanges which slideably guide the adjustable side walls of the form as it is moved to adjust to the width of the ditch side wall or to the desired width of the slab. The tool frame support is longitudinally pivoted from the frame of the machine on an axis that extends along and above the top portion of the ditch and is carried by one or more adjustable extensions at about the midpoint of the tool frame support.

6 Claims, 5 Drawing Figures

DITCH PAVING TOOL

BACKGROUND OF THE INVENTION

This invention is an improvement over the known prior art canal-lining tools that are briefly described in U.S. Pat. No. 3,936,211 as well as the tool disclosed and claimed in said patent.

SUMMARY OF THE INVENTION

In accordance with this invention the hopper and form construction and the suspending and adjusting functions of the tool shown in U.S. Pat. No. 3,936,211 are simplified and improved, the adjustable tool side walls are supported on each side of the form independent of the smoothing or finishing pan and the assembly is floated on the concrete being laid rather than extruding it from under a screed. The bottom edges of the form and the surface of the finishing pan are essentially coplanar rather than being off-set. The form wall parts are segmented so that a first lane or slab can be placed at the bottom margin of the sloping side wall of the ditch and subsequent slab laid adjacent thereto until the entire side wall is covered.

DESCRIPTION OF THE DRAWINGS

Illustrative embodiments of the invention are shown in the drawings in which.

DESCRIPTION OF THE PREFERRED EMBODIMENTS

Figure 1:
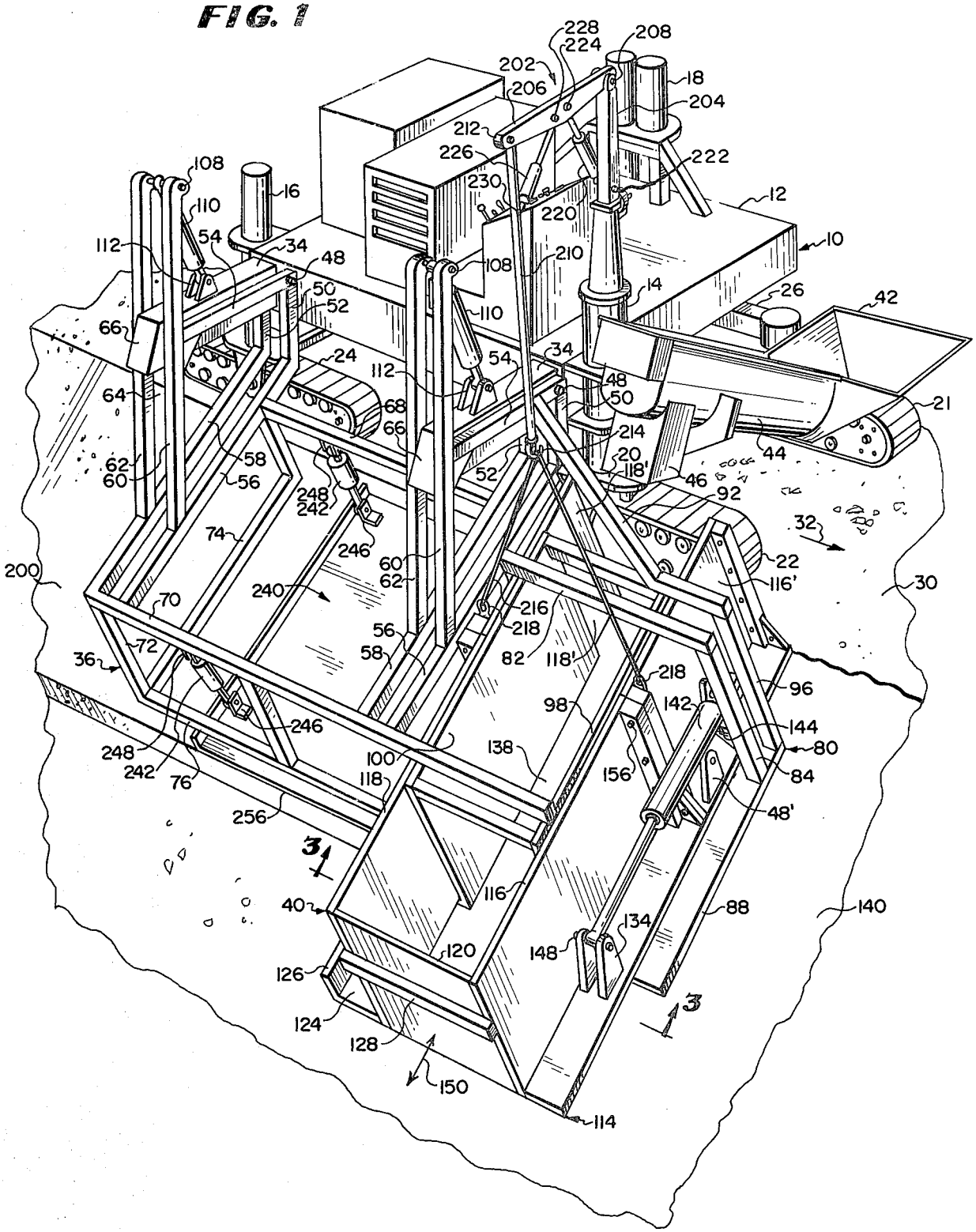
FIG. 1 is a side elevation of the drainage ditch slip-form of this invention shown attached to the side of a prime mover which may be a curb and gutter machine.

Referring to the drawings, particularly FIG. 1, a prime mover 10 is shown to include a main frame 12 of generally rectangular configuration, a vertically adjustable front support member 14, a rear vertically adjustable rear support member 16 and a central vertically adjustable side support member 18 placed opposite thereto. The support member 14 connects by means of the saddle 20 to the endless track unit 22 and the rear adjustable support connects through a saddle to its track unit 24. The adjustable support 18 connects by means of a central pivot to the walking beam 26 having a saddle-mounted track 21 (only one shown) at each end. Each track unit 22 and 24 is pivotally mounted on a vertical steering axis from its respective support 14 and 16. The track units 21 have their steering axes at the ends of the walking beam 26. The front pair of tracks 21–22 can be mechanically connected to steer in unison like the wheels of an automobile and the rear track units 21, 24 can be similarly connected and steered. A machine of this type is described in U.S. Pat. Nos. 3,606,827 and 3,710,695 to provide a five-point suspension as represented by the supports 14 and 16, the support 18 and the points at each end of the walking beam. The front pair of tractors 21–22 steer independently of the rear pair in either direction and each of the tractors has its individual drive motor (not illustrated) to propel the machine along the berm 30 with the speed of each being under finite control. Mechanical connection of the front and rear pairs of tractor units can be eliminated and a hydraulic feed-back control system used to steer the machine if desired.

The machine 10 may follow a grade line or other reference means to guide its path along the berm 30 and also control the adjustable supports automatically for finite grade and slope control as desired. Grade or elevation control is attained by independent actuation of the adjustable supports 14 and 16 while slope control, through a gravity actuated sensor or other grade reference, is attained by the actuation of the central support 18. The various steering, grade and slope functions and capabilities of the machine are known and described in the referenced patents. Accordingly, no additional description of them is necessary and its suffices that the machine or prime mover 10 is capable of traversing the grade or berm 30 in the direction of the arrow 32 and maintaining the frame 12 in a predetermined direction and a predetermined level or slope position and at a constant or predetermined height from the grade 30 or any other reference means.

The frame 12 is provided with a pair of spaced beams 34 that extend in parallel coplanar relationship from the outboard side of the machine and at the respective fore and aft corners of the frame. The beams 34 are individually adjustable so as to be extendable outwardly or inwardly (see arrow 35, FIG. 5) of the side of the frame 12 a distance sufficient to accommodate the frame 36 of the working tool 40. This mode of adjustment can be purely mechanical as by providing suitable guide means for each beam upon which to extend or retract in a straight line relationship or the adjustment can be hydraulic. The means for this adjustment are omitted for simplicity and since the mechanism therefor does not relate to the invention.

The frame 12 also supports the receiving hopper 42, the auger conveyor 44 and the discharge chute 46 adapted to receive concrete from a ready-mix truck and convey it to the tool 40 through the chute 44. These parts, though essential to the continuous operation of the machine, need no further description since they are well known.

The frame 36 is formed of a plurality of rigid tubular members that are welded together into a generally rectangular configuration extending longitudinally along the side of the machine and pivotally mounted from the beams 34 by means of the coaxial pivots 48 carried at the corners of the pair of upright members 50 and 52 with the pair of horizontal members 54 (only one each of the latter being visible in FIG. 1) that extend on each side of the beams 34.

Corresponding lower pairs of struts 56 and 58 extend from each of the uprights 50 and 52 at an angle and outwardly from the frame and coplanar vertically with the upper pair of horizontal members 54 (only one shown, the second being behind the beams 34).

The ends of the members 54 are affixed to the pairs of uprights 60 and 62 at about their midpoints and the bottom ends of these uprights 60 and 62 are affixed to and intermediate point to the respective lower struts 56 and 58. This construction defines a vertically oriented space, indicated at 64, between the uprights through which the ends 66 of the beams extend in guided relationship to take any longitudinal thrust forces that may act between the frame 36 and the tool 40.

The frame 36 includes a pair of upper longitudinal runners 68 and 70, the former being affixed inside the innermost angular struts 56 and 58 and the latter acting as a spacer for the ends of each of these pairs of struts at the outer edge of the frame. The pair of vertical spacers 72 at the rear of the frame 36 are tied to a lower strut 74 as a stiffener and also used for the attachment of auxiliary screed equipment. The lower outside longitudinal runner 76 joins the outer strut 72 and the strut 74 and ties to the rear lower edge of the screed guide member 80 (See FIG. 2) which is an essential part of the frame.

Figure 2:
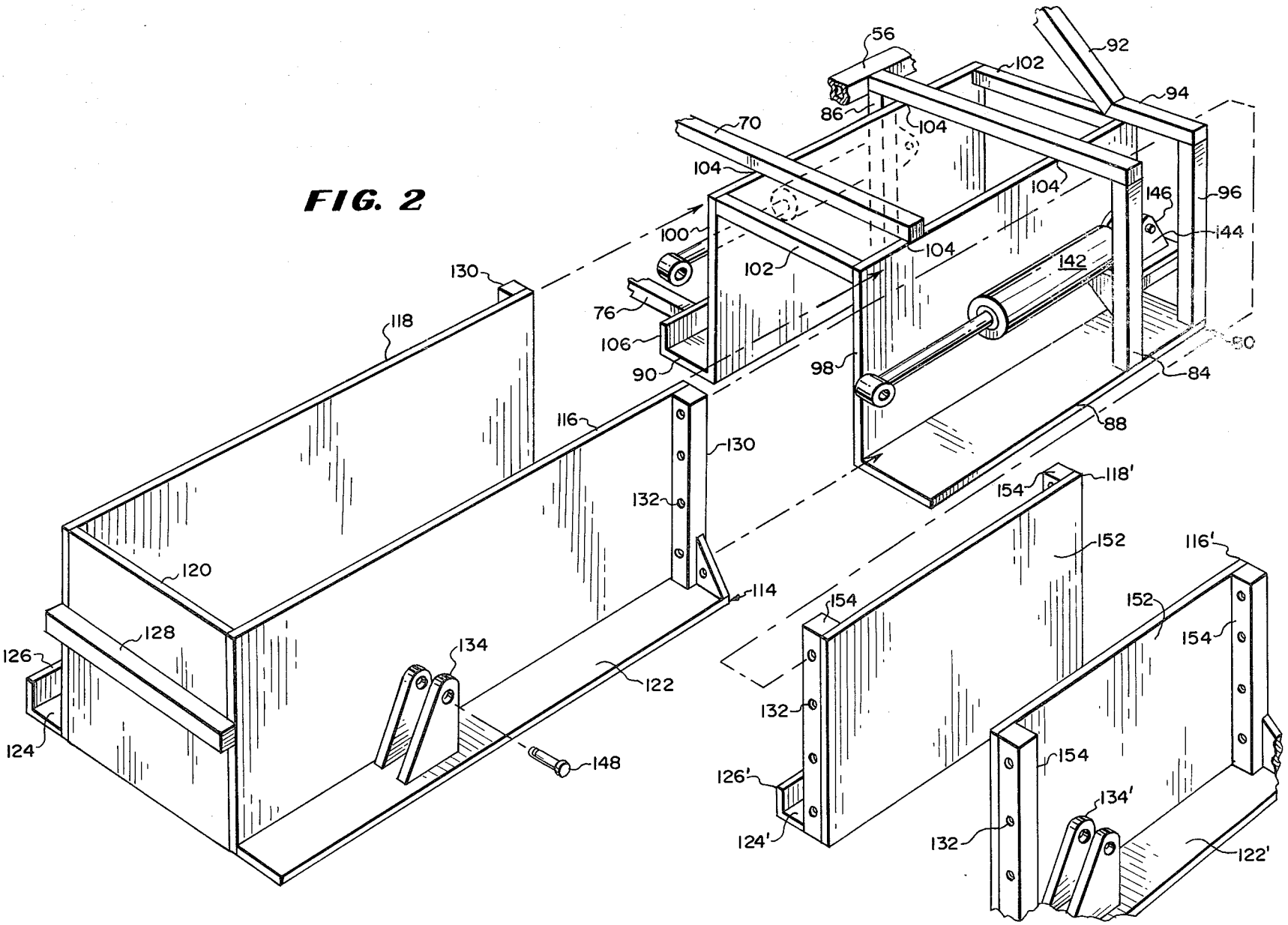
FIG. 2 is a fragmentary exploded view showing the extendable part of the tool detached to receive side inserts to elongate the assembly.

Further referring to FIGS. 1 and 2 it is seen that the screed guide member 80 is affixed to the frame assembly 36, thus far described, by the longitudinal runner 76 at the bottom and the upper longitudinal runners 68 and 70 as well as by the U-shaped frame 82 having the vertical support struts 84 and 86 affixed to the front angular strut 56 at the rear corner and to the front angular guide plate 88 and the rear angular guide plate 90. Also, the upper forward strut 54 is tied to the screed guide 80 by means of the diagonal strut 92, the spacer strut 94 and the upright tie member 96.

The screed guide 80 has the pair of vertical spaced plates 98 and 100 which are held in spaced parallel relationship by the spacers 102 and further braced by the weldments 104 attaching them to the frame member or runner 70 and the U-shaped bracket 82. The front guide plate 88 and the rear guide plate 90 are coplanar and extend along all or part of the lower edges of the vertical plates 98 and 100. The rear guide plate 90 includes an upstanding flange 106 which extends along the length thereof. The vertical supports 84, 86 and 96 are spaced outwardly from the vertical spaced plates 98 and 100, for purposes to be described.

The entire frame assembly 36 and the screed guide 80 thus far described are suspended from the frame 12 by means of the pair of pivots 48. The two pairs of uprights 60 and 62 have pivot pins 108 extending coaxially through their top ends and receive the operating rods of the rams 110 which are pivotally attached to the top of the beams 34 by means of the cleat and pin assemblies 112. The simultaneous extension of the rams 110 causes the entire frame assembly to assume various positions along the broken arrow 115 of FIG. 5. The hydraulic hoses for the arms 110 are omitted for simplicity.

Figure 3:
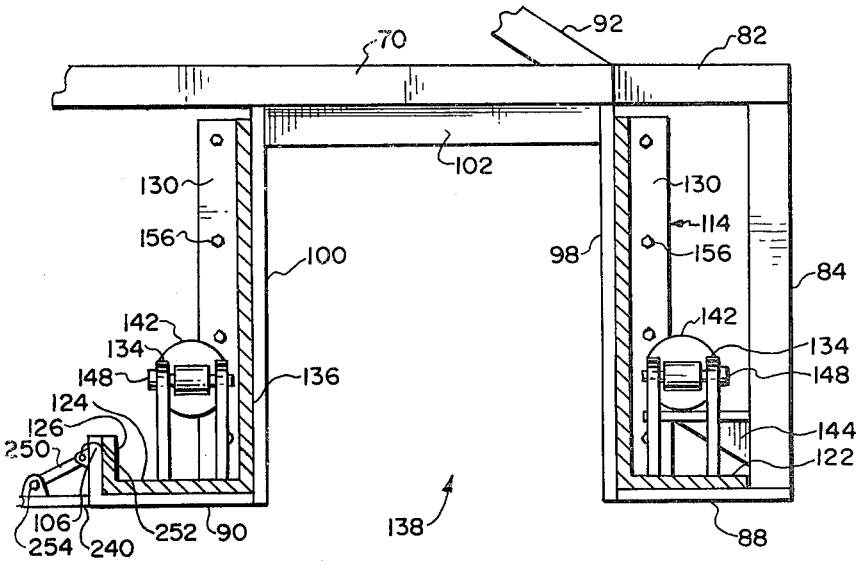
FIG. 3 is a cross-sectional view taken along the lines 3—3 of FIG. 1.

Referring to FIGS. 1, 2 and 3 there is provided a screed extension assembly 114 comprising a pair of flat parallel upright walls 116 and 118 joined at their extended ends by the transverse wall 120. The wall 116 has the bottom flange 122 welded thereto at right angles and the wall 118 has a similar right angle flange 124 also extending along its bottom edge. Both flanges are flat and coplanar with each other. The flange 124 has the upstanding flange 126 along its rear edge. Suitable reinforcement bars 128 are included. The innermost ends of the plates 116 and 118 each include an attaching cleat 130 having a series of spaced bore holes 132 therealong. The flanges 122 and 124 each include a pair of cleats 134 (shown best in FIG. 3).

The screed extension assembly 114 is adapted to be received by the screed guide member 80 with its walls 116 and 118 on the outside of the walls 98 and 100 as shown in FIG. 3 and in sliding contact therewith. The screed extension assembly 114 is supported by the engagement of its flanges 122 and 124 in sliding contact upon the flanges 88 and 90 respectively and under the lateral retention of the upstanding flange 106 which rides on the outside of the upstanding flange 126. The outer edge of the flange 122 fits inside the uprights 84 and 96. All of the clearances or face-to-face junctures 136 (FIG. 3) of these parts are in the order of about 1/16 to ⅛ inch to insure sliding contact without binding under normal temperature changes or the pressure of concrete controlled by the cooperating assemblies.

The screed extension assembly 114 thus supported by the frame 36 and screed guide 80 is free to reciprocate in the tilted plane of the frame 36 for the purpose of extending the length of the screed bottom opening 138 so that concrete from the hopper 42 delivered at the chute 46 can spread down the sloping side 140 of the ditch. This is accomplished in one embodiment by the pair of rams 142 which are carried at one end by the cleats 144 and pins 146 (only one set shown) affixed to the uprights 84 and 96 (see FIG. 2) and pivotally mounted by means of the pins 148 in the cleats 134 on the flanges 122 and 124 of the movable screed extension 114. The rams 142 are connected to the hydraulic system (not illustrated) of the prime mover so as to extend and retract simultaneously. The arrow 150 (FIG. 1) illustrates this function.

The screed extension 114 is about ⅓ to ½ longer than the screed guide 80 (see FIG. 2) and is normally of sufficient transverse length to provide the even release and spreading of the concrete under the rear flanges 124 and 90 in a path sufficient to cover a relatively steep-side ditch which is correspondingly narrow. However, as the width of the side 140 of the ditch and its depth increases it may be necessary to add the auxiliary sides 116' and 118' shown in FIGS. 1 and 2. For this purpose the pins 148 are of the quick-release variety allowing eash detachment of the rams 142 from the cleats 134 as shown in FIG. 2. Each of the auxiliary sides 116' and 118' is identical but reversed to include a plate 152 and the attaching cleats 154 at each end edge with the holes 132 spaced to match the holes 132 in the cleats 130 and receive the bolts 156 (FIGS. 1 and 3). One or more pairs of such auxiliary plates 116' and 118' can be used and would be similarly attached. Each plate has the corresponding flanges 122', 124' and 126' so that when attached, i.e., with the auxiliary plate 118' on the end of the plate 118 and the plate 116' on the end of the plate 116 a true and accurate extension of the screed 14 is formed and it will reciprocate in the screed support 80. The auxiliary plates 116' and 118' include the cleats 134' for re-attachment of the rams 142 using the pins 148.

Figure 4:
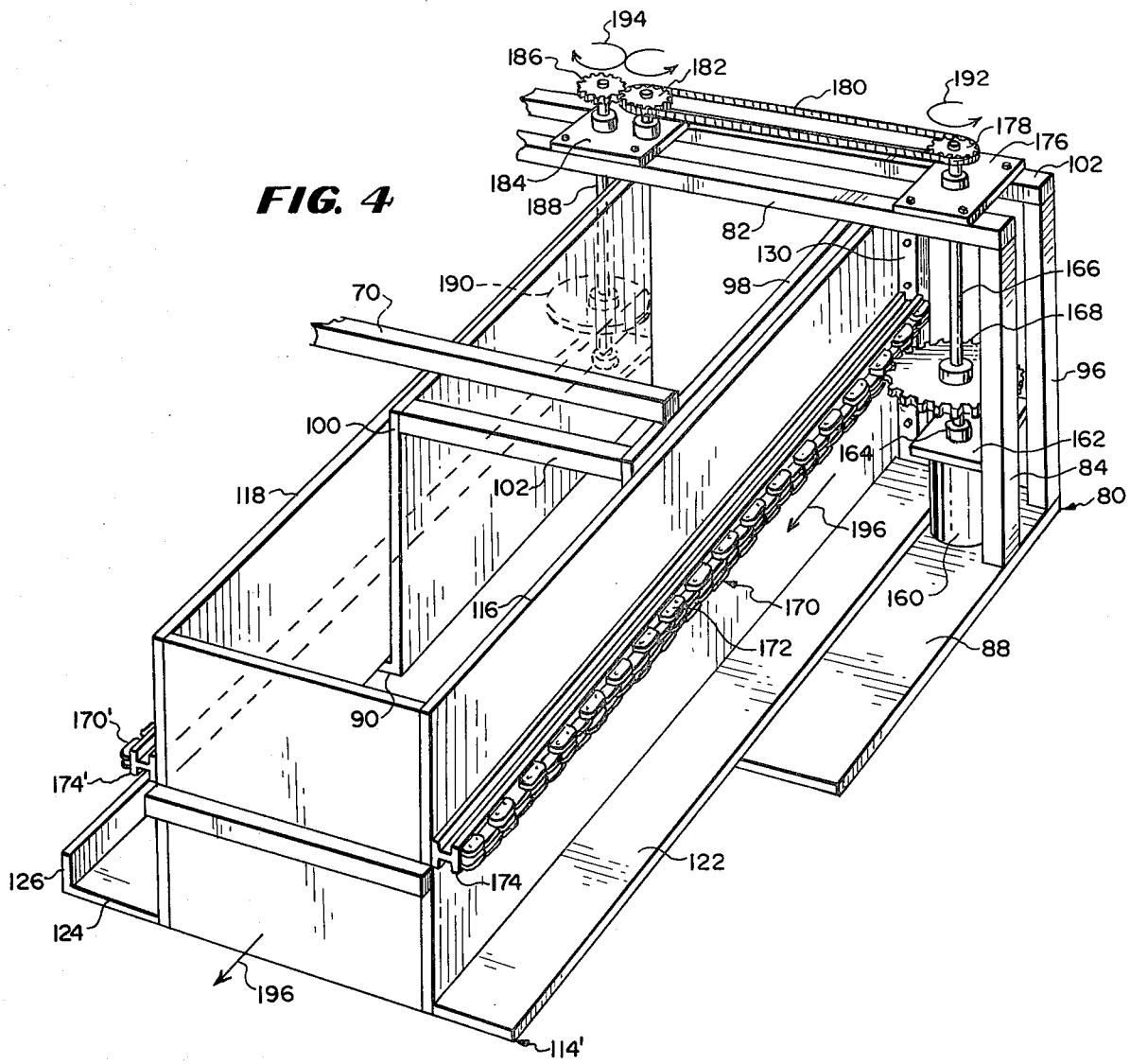
FIG. 4 is a fragmentary elevational view of a modified form of tool.

FIG. 4 illustrates another embodiment of the invention including modified means for extending and retracting the screed extension assembly 114 illustrated by the modified screed extension 114'. In this embodiment the rams 142 have been replaced by a single drive unit illustrated by the motor 160 which may be electrically or hydraulically driven. The motor 160 is supported on the flange 88 of the screed support 80 with the plate 162, supported from the uprights 84 and 96, containing the bearing 164 for the drive shaft 166. A first drive sprocket 168 is affixed to the shaft 166 in the plane of the elongated cog member 170 having a number of equally spaced cog pins 172 for engagement therewith. The cog member is supported from the side plate 116 by means of the I-beam 174 to insure straight-line relationship in the plane of the drive sprocket 168 as well as the required rigidity and strength of the assembly.

The upper end of the drive shaft 166 is supported by the bearing plate 176 and has affixed thereto a second drive sprocket 178 through a second bearing mount. This drive sprocket is connected by means of the driven chain 180 to a driven sprocket 182 supported in a third bearing plate 184. Both bearing plates are suitably affixed to the frame members 82 and 102. The driven sprocket 182 engages a second driven sprocket or gear 186 connected to the driven shaft 188 and having the third driven sprocket 190 (shown in broken lines) attached thereto for engagement, like the sprocket 168, with the elongated cog member 170' on the plate 118. The rotation of the shaft 166 in the direction of the arrow 192 will cause the opposite rotation as indicated by the arrow 194 of the shaft 188 and simultaneous driving of the sprockets 168 and 190 to extend the modified screed extension 114' in the direction of the arrow 196. Reversal of the drive motor 160 will retract the screed extension.

The remaining parts of the embodiment shown in FIG. 4 correspond to the screed guide member 80, already described, and only partially illustrated. Provision, by means of the cleat 130, is made for attaching the auxiliary side plates 116' and 118' to the assembly of FIG. 4. Other parts which are the same or serve the same functions are correspondingly numbered.

The parts that are provided to cause the extension and retraction of the screed portion 114 are necessarily of strong steel construction because of the weight of concrete which will fill the screed assembly as the concrete slab 200 (FIG. 1) is being laid. The various side walls that come into contact with and contain the concrete are of heavy gauge metal so that there is no tendency to bow under the hydrostatic pressure of the concrete.

The concrete slab 200 must be laid within certain limits of thickness along its length and width. Since the condition of the surface of the graded and compacted ditch side 140 will vary, the level of the concrete in the space 138 between the screed sides 98 and 100 as well as the level between the sides 116 and 118 of the adjustable screed wall 114 will also vary. Consequently the forces acting on the tool 80, its suspension and the machine are ever changing as the machine progresses along the path of travel. The weight or volumn of concrete carried by the hopper 42 and conveyor 44 is also fluctuating and the weight of concrete being confined within the tool and moved therealong are likewise factors in the balancing of forces acting on the tool. There is accordingly considerable drag on the side of the machine.

During actual tests it was found that there is also a lifting force on the tool, along the underside of the flanges 90 and 124 due to the tendency of these screed members to float upon the concrete. As a result, the tool must be held downwardly against the sloping side 140 of the ditch. Another factor affecting performance is the weight and drag of the screed extension 114 as it is lengthened and allows room for more concrete. It acts like a huge lever tending to twist the machine off course, especially when it is in the extended position. Although the weight of the machine 10 is considerable and the tractive force of its four tractor units is adequate, changes in the condition of the berm 30, obstacles in the path of travel and even the consistency of the concrete, all constitute forces which can and do, especially when combined, affect the accuracy with which the concrete slab 200 is laid.

Figure 5:
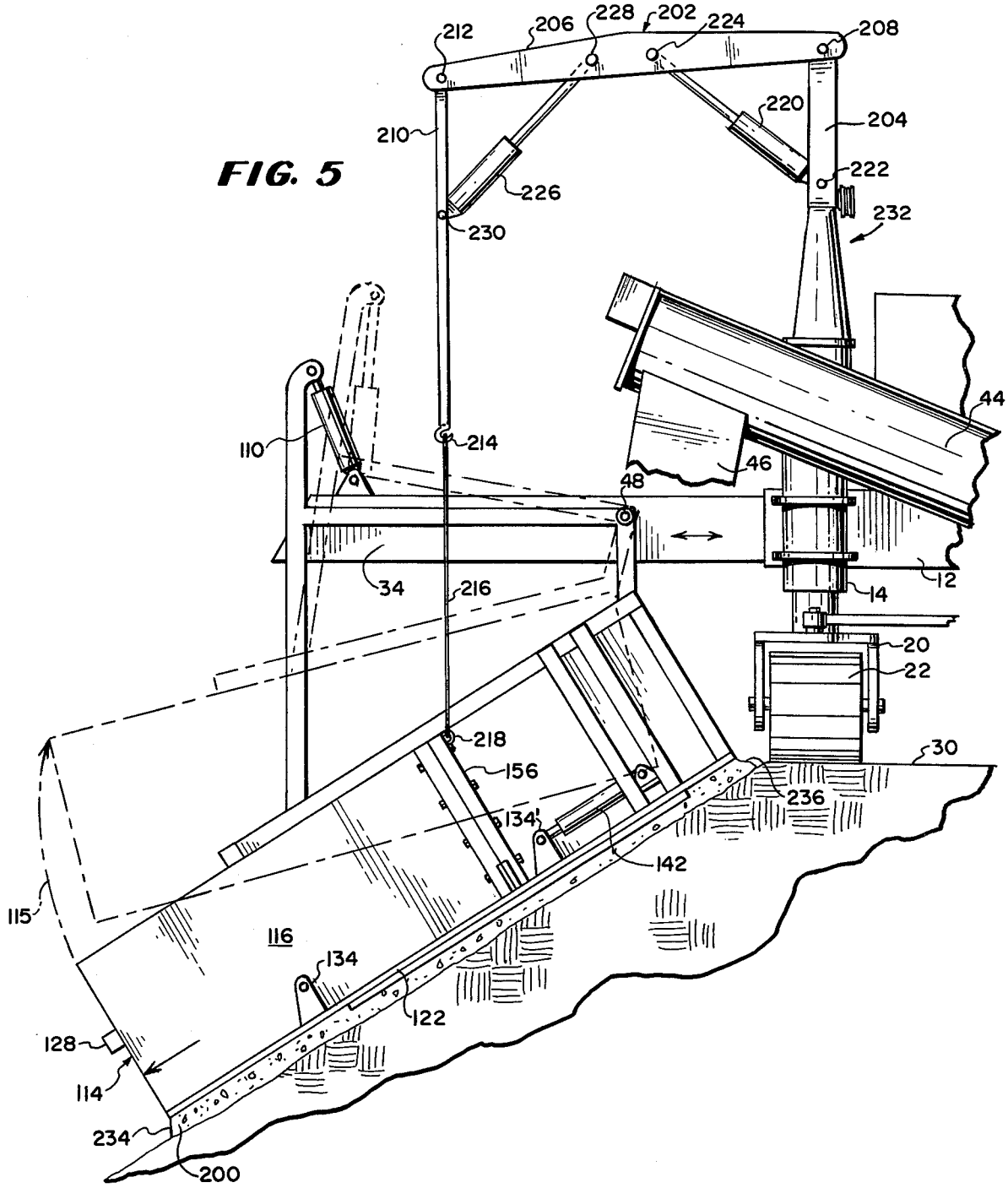
FIG. 5 is a fragmentary front elevation of the tool shown in FIG. 1 with parts shown in a broken line position of adjustment.

Accordingly, means are provided to balance or offset these forces while at the same time controlling the thickness of the concrete slab being poured. Referring to FIGS. 1 and 5 this is accomplished in accordance with one aspect of the invention by providing the crane or derrick assembly 202 whch includes the stancheon 204 connected to the top of the extensible member 14 and having the rocker arm 206 which is pivotally mounted at 208 at the top end thereof. At the other end of the rocker arm 206, the support link 210 is pivotally mounted by means of the pivot 212 and is provided at the lower end with a hook 214 that engages the cable harness 216. The cable may comprise two or more cable lengths that are affixed to the sliding screed assembly 114 at opposite points 218 intermediate its ends.

A ram 220 is pivotally connected at its ends 222 and 224 between the stancheon 204 and the rocker arm 206. This ram raises and lowers the pivot end 212 of the rocker arm. A second ram 226 is pivotally connected at its ends 228 and 230 between the rocker arm 206 and the link 210.

The derrick assembly 202 can include a bearing joint. 232 so that the upper stancheon portion 204 and rocking beam 206 are freely rotatable about a vertical axis During operation the concrete falls from the chute 46 into the space 138 (FIG. 3) between the walls 98 and 100 and due to the action of gravity spreads downwardly on the slope 140 against the end wall 120 of the assembly 114 which controls the width of the slab 200 (See FIG. 5). The bottom edge 234 (See FIG. 5) of the concrete is caused to flow against a previously laid bottom slab of concrete that may be in a horizontal plane across the bottom of the drainage ditch, in which case the top edge 236 of the slab will either be at an intermediate point along the sloping side 140 or at the top edge, depending on the width of the side 140. Alternately, the lower edge 234 may be laid in abutting relationship at an angle to a previously laid slab on the sloping side 140 with the top edge 236 at the generally level, pre-graded berm 30 as illustrated in FIG. 5.

The lateral or transverse distance between the two edges 234 and 236 of the slab 200 is subject to variation and control with the tool of this invention through the operation of the rams 142 or the direct drive unit shown in FIG. 4. The placement of the edge 236 at or near the berm 30 or at some pre-selected elevation along the slope 140 is also subject to control by means of the rams 110 which pivot the entire assembly about the pivots 48. This function, as shown by the arrow 115 and the exaggerated, broken line portion of the assembly in FIG. 5, also changes the thickness of the slab 200 at the lower end or edge 234. Any corresponding changes in the thickness of the slab 200 at the edge 236, (because of the action of the rams 110 in raising the tool assembly), which are not desired, are taken care of by the elevation adjustments at the supports 14–16 of the machine.

However, at the same time the derrick suspension 202 cooperates in several ways. The rams 220 and 226 can be locked in which event the support link 210 and the cable harness 216 function as a downward limit for the assembly 114, or a reference point that may be pre-adjusted to a desired maximum side slope for the slab 200. The ram 226 assures a straight line pull between the pivot 212 and the cable fasteners 218. The ram 220 may be operated to assist the rams 110. However, the rams 110 can operate to lift the assembly independent of the position of the beam 206.

Various forms of surface finishing auxiliary tools can be accommodated by the frame assembly 36 such as the screed pairs 240 having a lower edge 256 shown in FIG. 1 which is supported along its rear edge by means of the pair of rams 242 connected by suitable pivots 246 from its top surface to the runners 68 and 70 by the suitable pivots 248 at the top ends. The forward edge of the screed pan 240, as shown in FIG. 3, is maintained in the plane of the flange 90 by means of the pulling linkage or drag link 250 having the pivot points 252 and 254 supported by suitable pairs of double cleats, one pair being affixed to the upstanding rear flange 106 and the other on the top side of the pan 240.

I claim:

1. A ditch paving tool adapted to form a continuous layer of concrete along the sloping wall of a graded ditch upon being propelled therealong by a prime mover comprising:

a frame assembly including a pair of horizontal members supporting thereunder a framework angularly oriented with respect to said horizontal members;

said framework being disposable in a working relationship with the sloping wall of said ditch;

pivot means on said frame assembly for attaching to said prime mover for pivotal movement of said frame assembly therefrom on a generally horizontal axis;

at least a pair of upright support members extending from said frame assembly, and spaced laterally outward from said pivot means and having their upper ends above said horizontal axis;

a pair of front and rear guide means carried by the forward end of said frame assembly;

said pair of guide means being disposed and generally transverse said frame assembly;

the front guide means having a forwardly extending flange along its lower edge;

the rear guide means having a rearwardly extending flange along its lower edge;

a screed assembly carried by said pair of guide means and supported in sliding relationship on said flanges;

said screed assembly including enclosing substantially vertical side walls and an end wall adapted to retain said concrete for distribution in a continuous layer along said sloping wall;

power means connected between said pair of guide means and said screed assembly to extend and retract said screed assembly in relation to said pair of guide means whereby the width of said layer is controlled; and means operatively connected to said upright support members to pivot said guide means about said pivot means to maintain said lower edges in substantially parallel spaced relationship with said sloping side.

2. A ditch paving tool in accordance with claim 1 in which:

said means to extend and retract said screed assembly includes an extensible member connected between said pair of guide means and said screed assembly.

3. A ditch paving tool in accordance with claim 1 wherein:

at least a pair of additional vertical side walls is provided; and means are provided attaching said pair of side walls to the ends of said vertical side walls of said screed assembly in parallel spaced relationship to thereby extend the effective length thereof.

4. A ditch paving tool in accordance with claim 1 in which:

said means to extend and retract said screed assembly includes a pinion gear supported by said pair of guide means;

said screed assembly includes a gear rack adapted to be engaged by said pinion gear; and motor means are operatively associated with said pinion gear to reversibly drive said pinion gear.

5. A ditch paving tool in accordance with claim 1 including:

a derrick suspension adapted to be supported by said prime mover having an upright stancheon and a rocker arm pivotally attached therefrom to extend over said frame assembly;

a vertical support arm pivotally attached at its upper end to the extended end of said rocker arm;

a cable harness connected between the lower end of said support arm and said screed assembly; and means connecting said rocker arm to said stancheon to pivot said rocker arm in a vertical plane therefrom.

6. A ditch paving tool in accordance with claim 5 in which:

pivot means are operatively associated with said stancheon to support said stancheon on a vertical turning axis from said prime mover.

* * * * *